US005856280A

United States Patent [19]

Kim et al.

[11] Patent Number: 5,856,280

[45] Date of Patent: Jan. 5, 1999

[54] SULFUR-CONTAINING CARBOXYLIC ACID DERIVATIVES TO REDUCE DEPOSIT FORMING TENDENCIES AND IMPROVE ANTIOXIDANCY OF AVIATION TURBINE OILS

[75] Inventors: Jeenok T. Kim, Holmdel; Patrick Edward Godici, Millington; Paul Joseph Berlowitz, East Windsor; Morton Beltzer, Westfield, all of N.J.

[73] Assignee: Exxon Research and Engineering Company, Florham Park, N.J.

[21] Appl. No.: 794,958

[22] Filed: Feb. 4, 1997

Related U.S. Application Data

[63] Continuation-in-part of Ser. No. 678,910, Jul. 12, 1996, abandoned.

[51] Int. Cl.[6] ..... C10M 135/02; C10M 135/06

[52] U.S. Cl. ..... 508/509; 508/516; 508/518

[58] Field of Search ..... 508/509, 516, 508/518

[56] References Cited

U.S. PATENT DOCUMENTS

| | | | |
|---|---|---|---|
| 2,398,202 | 4/1946 | Zublin et al. . | |
| 2,462,200 | 2/1949 | Kleinholz | 508/509 |
| 2,884,379 | 4/1959 | Rudel et al. | 508/517 |
| 2,892,852 | 6/1959 | Koenig et al. | 508/516 |
| 3,492,233 | 1/1970 | Heppiewhite et al. . | |
| 3,509,214 | 4/1970 | Braid et al. . | |
| 3,573,206 | 3/1971 | Braid et al. . | |
| 3,755,176 | 8/1973 | Kinney et al. . | |
| 3,759,996 | 9/1973 | Braid . | |
| 3,773,665 | 11/1973 | Braid . | |
| 4,130,494 | 12/1978 | Shaub et al. . | |
| 4,157,971 | 6/1979 | Yaffe et al. . | |
| 4,174,284 | 11/1979 | Borel et al. . | |
| 4,189,388 | 2/1980 | Yaffe et al. . | |
| 4,559,153 | 12/1985 | Baldwin et al. | 508/509 |
| 4,786,424 | 11/1988 | Lindstrom | 508/509 |
| 4,800,031 | 1/1989 | Di Biase et al. | 508/501 |
| 4,820,430 | 4/1989 | Farng et al. . | |
| 5,478,485 | 12/1995 | Bialas et al. . | |
| 5,585,338 | 12/1996 | Behzer | 508/518 |

FOREIGN PATENT DOCUMENTS

| | | | |
|---|---|---|---|
| 0227948 | 7/1987 | European Pat. Off. | C08K 5/00 |
| 0434464 | 6/1991 | European Pat. Off. | C10M 141/08 |
| 63-210193 | 2/1987 | Japan | C10M 105/72 |
| 63-210194 | 2/1987 | Japan | C10M 105/72 |
| 63-265997 | 4/1987 | Japan | C10M 173/02 |
| 1287647 | 9/1972 | United Kingdom | C10M 3/40 |

*Primary Examiner*—Jacqueline V. Howard
*Assistant Examiner*—Cephia D. Toomer
*Attorney, Agent, or Firm*—Joseph J. Allocca

[57] ABSTRACT

The present invention resides in a turbo oil composition exhibiting enhanced antioxidancy and resistance to deposit formation, and to a method for achieving that result in turbo oils. The gas turbine lubricating oil of the present invention comprises a major proportion of synthetic polyol ester based base stock including diesters and polyol esters, preferably polyol ester based base stock and a minor proportion of an antioxidant/deposit control additive, specifically a sulfur-containing carboxylic acid (SCCA) derivative. Other conventional additives such as extreme pressure, pour point reduction, oxidative stability, anti-foaming, hydrolytic stability, improved viscosity index performance, anti-wear, and corrosion inhibitor additives and others may also be employed. The use of SCCA derivative produces a turbo oil exhibiting markedly superior oxidation stability and deposit control performance compared to that exhibited by turbo oil without the SCCA derivative.

20 Claims, No Drawings

SULFUR-CONTAINING CARBOXYLIC ACID DERIVATIVES TO REDUCE DEPOSIT FORMING TENDENCIES AND IMPROVE ANTIOXIDANCY OF AVIATION TURBINE OILS

CROSS REFERENCE TO RELATED APPLICATION

This application is a Continuation-In-Part of U.S. Ser. No. 678,910 which was filed on Jul. 12, 1996, now abandoned.

BACKGROUND OF THE INVENTION

1. Field of the Invention

This invention relates to ester-based, in particular diester and polyol ester-based turbo oils, which exhibit superior antioxidancy and reduced deposit forming tendencies. More particularly, it is related to turbo oils comprising esters of pentaerythritol with fatty acids as base stock, and a sulfur-containing carboxylic acid derivative, used as a dual functional additive providing enhanced oxidation stability and reduced deposit formation.

2. Description of the Related Art

Organic compositions such as mineral oils and lubricating compositions are subject to deterioration by oxidation and in particular are subject to such deterioration at high temperatures in the presence of air. This deterioration often leads to buildup of insoluble deposits which can foul engine parts, deteriorate performance, and increase maintenance. This is particularly the case for lubricating oils used in jet aircraft where wide temperature ranges and extreme operating conditions are likely to be encountered. Proper lubricating of aircraft gas turbines, for example, requires ability to function at bulk oil temperatures as low as −65° F. to as high as 450°–500° F.

Most lubricants contain additives to inhibit their oxidation. For example, U.S. Pat. No. 3,773,665 discloses a lubricant composition containing an antioxidant additive mixture of dioctyl diphenylamine and a substituted naphthylamine. U.S. Pat. Nos. 3,759,996; 3,573,206; 3,492,233, and 3,509,214 disclose various methods of oxidatively coupling alkylated diphenylamines with substituted naphthylamines.

U.S. Pat. No. 4,820,430 discloses the lubricant composition containing a copper salt of a propionic acid derivative or an additive prepared by reacting a suitable thiodipropionic acid derivative with a suitable alcohol or amine-containing compound to impart multifunctional and antioxidant characteristics.

U.S. Pat. No. 4,189,388 discloses synthetic lubricating oil composition having improved oxidation stability comprising pentaerythritol ester base oil and containing a phenylnaphthylamine, a dialkyldiphenyl amine, a polyhydroxy anthraquinone, a phosphate ester and a thioacid derivative. The thioacid derivatives mentioned are thio diester or diamide such as dilaurylthiodipropionate and N,N'-di(β-undecyl)thiodipropionamide.

U.S. Pat. No. 4,157,971 is directed to a similar lubricating oil composition as described in U.S. Pat. No. 4,189,388 except for the thioacid derivative being replaced by an alkyl thioacid ester. Examples of the alkylthioacid ester include 2-butylthio-isooctyl glycolate, 3-butylthio-isohexyl propionate.

U.S. Pat. No. 4,174,284 discloses liquid hydrocarbon-containing organic composition exhibiting improved antioxidation properties in the presence of a hydrocarbylpolythiobenzoic acid. The number of sulfur atoms in a polythio linkage ranges from 2 to 8, and the examples of such compounds cited include 2-n-hexyl-dithiobenzoic acid and 2-n-dodecyltetrathio-4-cyclohexylbenzoic acid.

JP 63,210,194-A discloses thermally and oxidatively stable lube useful as compressor oil, turbo-charger oil, etc. that contains thiodipropionate ester obtained from thiodipropionic acid and tertiary alcohol.

EP 227,948-A discloses a polyolefin stabilizing composition containing a tris-alkyl-phenyl phosphite (I) and a dialkyl-thio-dipropionate (II). II synergistically enhances the stabilizing effectiveness of I to improve the melt-processing and color stability of the polyolefin.

It has now been discovered that the anti-deposition and antioxidant properties of the polyol ester-based turbo oils can be greatly enhanced by the addition of a small amount of a sulfur containing additive, specifically sulfur-containing carboxylic acid derivatives such as thiosalicylic acid (TSA) or thioethers such as thiodipropionic acid (TDPA).

SUMMARY OF THE INVENTION

The present invention resides in a turbo oil composition exhibiting enhanced antioxidancy and resistance to deposit formation, and to a method for achieving that result in turbo oils.

The gas turbine lubricating oil of the present invention comprises a major proportion of synthetic polyol ester based base stock including diesters and polyol esters, preferably polyol ester based base stock and a minor proportion of an antioxidant/deposit control additive, specifically a sulfur-containing carboxylic acid (SCCA) derivatives. Other, conventional additives such as extreme pressure, pour point reduction, oxidative stability, anti-foaming, hydrolytic stability, improved viscosity index performance, anti-wear, and corrosion inhibitor additives and others may also be employed.

The use of SCCA derivatives produces a turbo oil exhibiting markedly superior oxidation stability and deposit control performance to that exhibited by turbo oil without the SCCA derivatives.

DETAILED DESCRIPTION

A turbo oil having unexpectedly superior deposition performance comprises a major portion of a synthetic ester base oil and minor portion of a SCCA derivative. Synthetic esters include diesters and polyol esters.

The diesters that can be used for the improved anti-deposition turbo oil of the present invention are formed by esterification of linear or branched $C_6$–$C_{15}$ aliphatic alcohols with one of such dibasic acids as adipic, sebacic, or azelaic acids. Examples of diesters are di-2-ethylhexyl sebacate and dioctyl adipate.

The synthetic polyol ester base oil is formed by the esterification of an aliphatic polyol with carboxylic acid. The aliphatic polyol contains from 4 to 15 carbon atoms and has from 2 to 8 esterifiable hydroxyl groups. Examples of polyol are trimethylolpropane, pentaerythritol, dipentaerythritol, neopentyl glycol, tripentaerythritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the formula

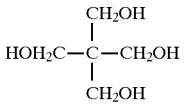

I and about 12% of dipentaerythritol having the formula

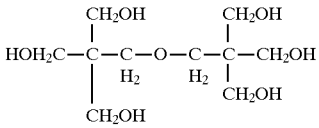

II

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaertythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the polyol ester base stock is added a minor portion of sulfur containing carboxylic acid derivative as antideposition and oxidation inhibition additive.

Sulfur containing carboxylic acid derivatives are described by the structural formula:

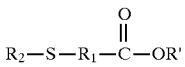

III where $R_1$ is $C_2$–$C_{12}$ alkylene with the carboxy group separated from S by a linear alkylene group containing at least 2 carbons, arylene, $C_1$ to $C_8$ alkyl substituted arylene, R'is hydrogen, or $C_1$ to $C_8$ alkyl, $R_2$ is hydrogen, or the group

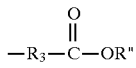

IV and wherein when $R_2$ is

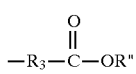

V $R_1$ and $R_3$ are the same or different $C_2$–$C_{12}$ alkylene with the carboxy groups separated from S by a linear alkylene group containing at least two carbons, arylene, $C_1$–$C_8$ alkyl substituted arylene and R' and R" are the same or different and are hydrogen, $C_1$–$C_8$ alkyl. It is preferred that at least one of R' and R" is hydrogen.

Representative of sulfur containing carboxylic acid derivatives corresponding to the above description are mercapto carboxylic acids or their ester of the formula:

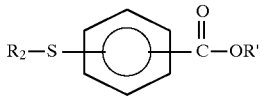

VI and its various isomers where $R_2$ and R' are as previously defined, preferably $R_2$ and R' are hydrogen, and thioether carboxylic acids (TECA) or their ester of the structural formula:

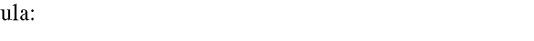

VII where $R_1$ and $R_3$ are same or different and are $C_2$–$C_{12}$ alkylene with the carboxy group separated from S by a linear alkylene group containing at least 2 carbons, and R' and R" are the same or different and are H or $C_1$–$C_8$ alkyl. It is preferred that at least one of R' and R" is hydrogen.

The preferred TECA are those wherein $R_1$ and $R_3$ are $C_2$–$C_4$ linear alkylene and either or both of R' and R" are hydrogen, preferably both are hydrogen.

The SCCA derivative is used in an amount in the range 100 to 2000 ppm, preferably 200 to 1000 ppm, most preferably 300 to 600 ppm.

The reduced-deposit oil, preferably synthetic polyol ester-based reduced-deposit oil, may also contain one or more of the following classes of additives: antifoamants, antiwear agents, corrosion inhibitors, hydrolytic stabilizers, metal deactivator, detergents and additional antioxidants. Total amount of such other additives can be in the range 0.5 to 15 wt %, preferably 2 to 10 wt %, most preferably 3 to 8 wt %.

Antioxidants which can be used include aryl amines, e.g., alkylated phenylnaphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an amount in the range 0.5 to 4 wt %, preferably 1 to 3 wt %.

Corrosion inhibitors include but are not limited to various triazols e.g., tolyl triazole, 1,2,4 benzene triazole, 1,2,3 benzene triazole, carboxy benzotriazole, alkylated benzotriazole and organic diacids, e.g., sebacic acid.

The corrosion inhibitors can be used in an amount in the range 0.02 to 0.5 wt %, preferably 0.05% to 0.25 wt %.

As previously indicated, other additives can also be employed including hydrolytic stabilizers, pour point depressants, anti-foaming agents, viscosity and viscosity index improvers, etc.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pp. 1–11, the disclosures of which are incorporated herein by reference.

The additive combinations are useful in ester fluids including lubricating oils, particularly those ester fluids useful in high temperature avionic (turbine engine oils) applications. The additive combinations of the present invention exhibit excellent deposit inhibiting performance and improved oxidative stability as measured in the Inclined Panel Deposition Test.

The present invention is further described by reference to the following non-limiting examples.

EXAMPLE 1

This example illustrates the deposition performance for the most preferred embodiment of the invention by evaluating fully formulated oils in the Inclined Panel Deposit Test ("IPDT"). The most preferred TECA derivative is 3,3' thiodipropionic acid (TDPA), compound VII with R' and R" as H and $R_1$ and $R_3$ as $C_2H_4$. The TDPA was blended into finished turbo oil formulations suitable for applications covered by the MIL-L-23699 specifications. The base stocks used in these formulations were a technical pentaerithritol (PE) ester made with an acid mixture of $C_5$ to $C_{10}$ commercially available acids. The additive package contained diaryl amine antioxidants, a commonly used metal passivator containing triaryl phosphates, a corrosion inhibitor consisting of alkylated benzotriazole, and a hydrolytic stabilizer.

The IPDT is a bench test consisting of a stainless steel panel electrically heated by means of two heater inserted into holes in the panel body. The test temperature is held at a constant level thuoughout the 24 hour run and monitored using a recording thermocouple. The panel is inclined at a 4° angle and oil is dropped onto the heated panel near the top, allowing the oil to flow the length of the panel surface, drip from the end of the heated surface and be recycled to the oil reservoir. The oil forms a thin moving film which is in contact with air flowing through the test chamber. Deposits formed on the panel are rated on a scale identical to that used for deposits formed in the bearing rig test (FED. Test Method STD. No. 791C, Method 3410.1). Varnish deposits rate from 0 (clean metal) to 5 (heavy varnish). Sludge deposits rate from 6 (light) to 8 (heavy). Carbon deposits rate from 9 (light carbon) to 11 (heavy/thick carbon). Higher ratings (12 to 20) are given to carbon deposits that crinkle or flake away from the metal surface during the test. The total weight of the deposit formed in 24 hours is also measured. In addition, the final viscosity, measured at 40° C., and Total Acid Number ("TAN"), expressed as mg KOH/g, of the used oil are measured after the test is complete. The changes in the measured viscosity and TAN are used to evaluate the oxidation resistance of the oil.

Table 1 shows that the use of TDPA at 0.05 wt % (based on base stock) significantly improves the antioxidancy and reduces the deposit formation of the finished turbo oil in the IPDT run at three different temperatures: 560°, 570° and 580° F. In evaluating the effect of TDPA, a series of base finished turbo oils (FTO1, FTO2, FTO3) were used. To each of these base FTO formulations, 0.05 wt % TDPA was added, allowing a direct pair-wise comparison of performance with and without TDPA. The composition of FTO1, FTO2 and FTO3 differs slightly in the fatty acid distribution (i.e., 40 mole % n-$C_5$ acid in FTO1 and FTO2; 55 mole % n-$C_5$ acid in FTO3) and in the aryl amine antioxidant concentration (2.7 wt % in FTO1, 1.9 wt % in FTO2, 2.5 wt % in FTO3). In each of these base FTO formulations, the addition of 0.05% TDPA improved the IPDT rating and dramatically reduced the deposit formation, and viscosity and TAN increase as compared with the formulations which did not contain TDPA. The reduced viscosity and TAN increase are unexpected with the reduced deposit weight, which may result from solubilization of incipient deposits by the oil resulting in a larger concentration of high molecular weight, partially oxidized molecules in solution thus increasing the viscosity and TAN. However, Table 1 clearly illustrates that no such effect is observed. The viscosity and TAN changes are dramatically lower for the TDPA-containing formulations indicating that not only are deposits reduced, but incipient deposits and other partially oxidized species are not formed in the same quantities when the TDPA is present.

Table 1 also contains data relating to the use of the half ester and full ester of TDPA. The full ester, thiodipropionic methyl ester (TDME) was found to be an effective deposit control additive, as was the half ester of TDPA, n-heptyl-β-(2 carboxyethyl mercapto)-propionate (HCP). Surprisingly, thiodiacetic acid (TDAA) was found to be ineffective as a deposit control additive. This inactivity of TDAA may be attributed to the absence of a mobile β-H, which is necessary for the TECA derivatives to scavenge radicals from the base stock oxidation.

TABLE 1

| Oil Sample | IPDT Temp. (°F.) | Deposit Rating | Deposit Weight (g) | % Viscosity Increase | TAN Increase (mg KOH/g oil) |
|---|---|---|---|---|---|
| FTO1 | 560 | 2.61 | 0.11 | 19.3 | 2.65 |
| FTO1 + 0.05% TDPA | 560 | 1.42 | 0.04 | 4.6 | 0.30 |
| FTO1 | 580 | 3.78 | 0.31 | 137.4 | 10.69 |
| FTO1 + 0.05% TDPA | 580 | 1.97 | 0.10 | 9.1 | 0.95 |
| FTO1 + 0.05% TDME | 580 | 3.00 | 0.09 | 10.4 | — |
| FTO1 + 0.05% TDAA | 580 | 4.27 | 0.25 | 61.9 | — |
| FTO1 + 0.05% HCP | 580 | 2.06 | 0.05 | 7.2 | 0.89 |
| FTO2 | 570 | 4.3 | 0.24 | 101.0 | 14.2 |
| FTO2 + 0.05% TDPA | 570 | 2.91 | 0.12 | 16.2 | 1.51 |
| FTO3 | 560 | 3.25 | 0.15 | 81.1 | 6.54 |
| FTO3 + 0.05% TDPA | 560 | 1.39 | 0.07 | 9.2 | 0.12 |

EXAMPLE 2

The similar deposition and antioxidancy benefit as shown in Example 1 is illustrated with another SCCA derivative, namely thiosalicylic acid (TSA); compound VI with $R_2$ and R' being H. As in Example 1, two different finished turbo oil formulations as denoted by FTO4 and FTO5 were used to evaluate the performance advantage of TSA. The composition of FTO4 and FTO5 are similar to that of FTO3 except that the PE ester base stock of FTO4 has higher mole % (57%) of n-$C_5$ acid than that of FTO3, and FTO5 contains a lower amine antioxidant treat rate (approximately 1.6 wt %) than FTO3. In the IPDT ran at 560° or 570° F., the use of TSA effected concomitant improvement in the deposition and oxidation stability, the latter indicated by the dramatically lower viscosity and TAN increase as compared to the base formulations.

TABLE 2

| Oil Sample | IPDT Temp. (°F.) | Deposit Rating | Deposit Weight (g) | % Viscosity Increase | TAN Increase (mg KOH/g oil) |
|---|---|---|---|---|---|
| FTO4 | 560 | 3.01 | 0.25 | not available | 9.49 |
| FTO4 + 0.03% TSA | 560 | 2.01 | 0.12 | not available | 0.42 |
| FTO4 | 570 | 4.12 | 0.30 | 98.4 | 3.9 |
| FTO4 + 0.03% TSA | 570 | 3.77 | 0.10 | 10.7 | 1.1 |
| FTO5 | 570 | 3.65 | 0.19 | 97.3 | 10.33 |
| FTO5 + 0.1% TSA | 570 | 3.40 | 0.07 | 18.6 | 1.96 |

EXAMPLE 3

Table 3 illustrates that using other SCCA compounds such as thiophene carboxylic acid (TCA) and 2-dodecylthio-5-mercapto-1,3,4-thiadiazole-5-acetic acid (DTAA) did hot offer the deposition and oxidation stability benefit as TDPA and TSA. The base turbo oil formulations used to blend in TCA and DTAA are same as two of the TDPA-containing formulations shown in Example 1.

TABLE 3

| Oil Sample | IPDT Temp. (°F.) | Deposit Rating | Deposit Weight (g) | % Viscosity Increase | TAN Increase (mg KOH/g oil) |
|---|---|---|---|---|---|
| FTO3 | 560 | 3.25 | 0.15 | 81.0 | 6.54 |
| FTO3 + 0.05% DTAA | 560 | 3.34 | 0.35 | 101.1 | 81.7 |
| FTO3 + 0.05% TCA | 560 | 3.47 | 0.32 | 120.2 | 11.16 |
| FTO1 | 580 | 3.78 | 0.31 | 137.4 | 10.69 |
| FTO1 + 0.05% TCA | 580 | 3.64 | 0.29 | 190.5 | 9.65 |

What is claimed is:

1. A turbo oil composition exhibiting enhanced resistance to deposition and improved oxidative stability, said turbo oil formulation comprising a major portion of a synthetic ester based base stock and a minor portion of a sulfur containing carboxylic acid (SCCA) derivative, wherein the SCCA derivative is represented by the structural formula:

$$R_2-S-R_1-\overset{\overset{\displaystyle O}{\|}}{C}-OR'$$

wherein $R_1$ is $C_2$–$C_{12}$ alkylene with the —COOR' separated from S by a linear alkylene group containing at least 2 carbons, arylene, $C_1$ to $C_8$ alkyl substituted arylene, R' is $C_1$ to $C_8$ alkyl, $R_2$ is hydrogen.

2. A turbo oil composition exhibiting enhanced resistance to deposition and improved oxidative stability, said turbo oil formulation comprising a major portion of a synthetic ester based base stock and a minor portion of a sulfur containing carboxylic acid (SCCA) derivative, wherein the SCCA derivative is represented by the structural formula:

$$R_2-S-R_1-\overset{\overset{\displaystyle O}{\|}}{C}-OR'$$

wherein $R_1$ is $C_2$–$C_{12}$ alkylene with the —COOR' group separated from S by a linear alkylene group containing at least 2 carbons, arylene, $C_1$ to $C_8$ alkyl substituted arylene, R' is hydrogen or $C_1$ to $C_8$ alkyl, $R_2$ is the group $$-R_3-\overset{\overset{\displaystyle O}{\|}}{C}-OR''$$

wherein $R_1$ and $R_3$ are the same or different and are $C_2$–$C_{12}$ alkylene with the —COOR group separated from S by a linear alkylene group containing at least 2 carbons, arylene, $C_1$ to $C_8$ alkyl substituted arylene, and R' and R" are different and are hydrogen, and $C_1$–$C_8$ alkyl.

3. A turbo oil composition exhibiting enhanced resistance to deposition and improved oxidative stability, said turbo oil formulation comprising a major portion of a synthetic ester based base stock and a minor portion of a sulfur containing carboxylic acid (SCCA) derivative, wherein the SCCA derivative is represented by the structural formula:

$$R_2-S-R_1-\overset{\overset{\displaystyle O}{\|}}{C}-OR'$$

wherein $R_1$ is $C_2$–$C_4$ alkylene with the —COOR' group separated from S by a linear alkylene group containing at least 2 carbons, arylene, R' is hydrogen or $C_1$ to $C_8$ alkyl, $R_2$ is the group $$-R_3-\overset{\overset{\displaystyle O}{\|}}{C}-OR''$$

wherein $R_1$ and $R_3$ are the same or different and are $C_2$–$C_4$ alkylene with the —COOR' and COOR" groups separated from S by a linear alkylene group containing at least 2 carbons, arylene and R" is hydrogen.

4. A method for enhancing the resistance to deposition and improve the oxidation stability of a synthetic ester based turbo oil by adding to said turbo oil in an amount in the range 100 to 2000 ppm a sulfur containing carboxylic acid (SCCA) derivative, wherein the SCCA derivative is represented by the structural formula:

$$R_2-S-R_1-\overset{\overset{\displaystyle O}{\|}}{C}-OR'$$

wherein $R_1$ is $C_2$–$C_{12}$ linear alkylene, with the —COOR' group separated from S by a linear alkylene group containing at least 2 carbons, R' is hydrogen or $C_1$ to $C_8$ alkyl, $R_2$ is hydrogen, or the group $$-R_3-\overset{\overset{\displaystyle O}{\|}}{C}-OR''$$

and wherein when $R_2$ is $$-R_3-\overset{\overset{\displaystyle O}{\|}}{C}-OR''$$

$R_1$ and $R_3$ are the same or different and are $C_2$–$C_{12}$ linear alkylene, with the —COOR' and —COOR" groups separated from S by a linear alkylene group containing at least 2 carbons, and R' and R" are the same or different and are hydrogen and $C_1$–$C_8$ alkyl.

5. A turbo oil composition exhibiting enhanced resistance to deposition and improve the oxidation stability, said turbo oil formulation comprising a major amount of a synthetic ester based base stock and a minor portion of a sulfur containing carboxylic acid (SCCA) derivative, wherein the SCCA derivative is represented by the structural formula:

$$R_2-S-R_1-\overset{\overset{\displaystyle O}{\|}}{C}-OR'$$

wherein $R_1$ is $C_2$–$C_4$ alkylene with the —COOR' group separated from S by a linear alkylene group containing at least 2 carbons, R' is hydrogen or $C_1$ to $C_8$ alkyl, $R_2$ is hydrogen, or the group $$-R_3-\overset{\overset{\displaystyle O}{\|}}{C}-OR''$$

and wherein when $R_2$ is $$-R_3-\overset{\overset{\displaystyle O}{\|}}{C}-OR''$$

$R_1$ and $R_3$ are the same or different and are $C_2$–$C_4$ alkylene with the —COOR' and —COOR" groups separated from S by a linear alkylene group containing at least 2 carbons and R" is hydrogen.

6. The turbo oil composition of claim 2, 3 or 5 wherein the SCCA derivative is used in an amount in the range 100 to 2000 ppm.

7. The turbo oil composition of claim 2, 3 or 5 wherein the synthetic ester based base stock is the esterification product of an aliphatic polyol containing 4 to 15 carbon atoms and from 2 to 8 esterifiable hydroxyl groups reacted with a carboxylic acid containing from 4 to 12 carbon atoms.

8. The turbo oil composition of claim 7 wherein the synthetic ester based base stock is the esterification product of technical pentaerythritol and a mixture of $C_4$ to $C_{12}$ carboxylic acids.

9. The turbo oil composition of claim 2 wherein the sulfur containing carboxylic acid derivative is represented by the structural formula $$R''OOC-R_3-S-R_1-COOR'$$

where $R_1$ and $R_3$ are the same or different and are $C_2$–$C_{12}$ alkylene with the —COOR' and —COOR" groups separated from S by a linear alkylene group consisting of at least 2 carbons, and R' and R" are different and are H and $C_1$–$C_8$ alkyl.

10. The turbo oil composition of claim 2 wherein the sulfur containing carboxylic acid derivative is represented by the structural formula:

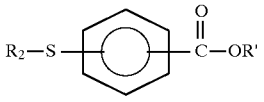

wherein R' is hydrogen or $C_1$–$C_8$ alkyl, $R_2$ is the group wherein R' is hydrogen or $C_1$–$C_8$ alkyl,
$R_2$is [hydrogen, or] the group $$-R_3-\overset{\overset{\displaystyle O}{\|}}{C}-OR''$$

wherein $R_3$ is $C_2$–$C_{12}$ alkylene with the —COOR" group separated from S by a linear alkylene group containing at least 2 carbons, arylene, $C_1$–$C_8$ alkylsubstituted arylene, and R' and R" are different and are hydrogen and $C_1$–$C_8$ alkyl.

11. The turbo oil of claim 3 wherein both of R' and R" are H.

12. The turbo oil composition of claim 3 wherein both of R' and R" are hydrogen and $R_3$ and $R_1$ are $C_2$–$C_4$ linear alkylene.

13. The method of claim 4 wherein in the sulfur containing carboxylic acid $R_1$ is $C_2$–$C_4$ alkylene and R' and R" are both hydrogen.

14. A method for enhancing the resistance to deposition and improve the oxidation stability of a synthetic ester based turbo oil by adding to said turbo oil a sulfur containing carboxylic acid (SCCA) derivative in an amount in the range 100 to 2000 ppm, wherein the SCCA derivative is represented by the structural formula:

$$R_2-S-R_1-\overset{\overset{\displaystyle O}{\|}}{C}-OR'$$

wherein $R_1$ is $C_2$–$C_{12}$ alkylene with the —COOR' group separated from S by a linear alkylene group containing at least 2 carbons, arylene, $C_1$ to $C_8$ alkyl substituted arylene, R' is $C_1$ to $C_8$ alkyl and $R_2$ is hydrogen.

15. A method for enhancing the resistance to deposition and improve the oxidation stability of a synthetic ester based turbo oil by adding to said turbo oil a sulfur containing carboxylic acid (SCCA) derivative in an amount in the range 100 to 2000 ppm, wherein the SCCA derivative is represented by the structural formula:

$$R_2-S-R_1-\overset{\overset{\displaystyle O}{\|}}{C}-OR'$$

wherein $R_1$ is $C_2$–$C_{12}$ alkylene with the —COOR' group separated from S by a linear alkylene group containing at least 2 carbons, arylene, $C_1$ to $C_8$ alkyl substituted arylene, R' is hydrogen or $C_1$ to $C_8$ alkyl, $R_2$ is the group $$-R_3-\overset{\overset{\displaystyle O}{\|}}{C}-OR''$$

wherein $R_1$ and $R_3$ are the same or different and are $C_2$–$C_{12}$ alkylene with the —COOR' and —COOR" groups separated from S by a linear alkylene group containing at least 2 carbons, arylene, $C_1$ to $C_8$ alkyl substituted arylene, and R' and R" are the same or different and are hydrogen and $C_1$–$C_8$ alkyl.

16. The method of claim 15 or 4 wherein both of R' and R" are H.

17. The method of claim 15, 14 or 4 wherein the synthetic ester based base stock to which the SCCA is added is the esterification product of an aliphatic polyol containing 4 to 15 carbon atoms and from 2 to 8 esterifiable hydroxyl groups reacted with a carboxylic acid containing from 4 to 12 carbon atoms.

18. The method of claim 17 wherein the synthetic ester based base stock is the esterification product of technical pentaeythritol and a mixture of $C_4$ to $C_{12}$ carboxylic acids.

19. The method of claim 15 wherein the sulfur containing carboxylic acid derivative is represented by the structural formula $$R''OOC-R_3-S-R_1-COOR'$$

wherein $R_1$ and $R_3$ are the same or different and are $C_2$–$C_{12}$ alkylene with the —COOR' or COOR" group separated from S by a linear alkylene group containing at least 2 carbons and R' and R" are different and are H and $C_1$–$C_8$ alkyl.

20. The method of claim 15 wherein in the sulfur containing carboxylic acid $R_1$ is arylene.

* * * * *